US007695304B2

(12) United States Patent
Chiang et al.

(10) Patent No.: US 7,695,304 B2
(45) Date of Patent: Apr. 13, 2010

(54) ELECTRICAL CONNECTOR WITH LATCHING MEMBER

(75) Inventors: Shu-Man Chiang, Tu-Cheng (TW); Mei-Chuan Yang, Tu-Cheng (TW)

(73) Assignee: Cheng Uei Precision Industry Co., Ltd., Taipei Hsien (TW)

( * ) Notice: Subject to any disclaimer, the term of this patent is extended or adjusted under 35 U.S.C. 154(b) by 65 days.

(21) Appl. No.: 12/190,434

(22) Filed: Aug. 12, 2008

(65) Prior Publication Data

US 2010/0041267 A1 Feb. 18, 2010

(51) Int. Cl.
*H01R 13/627* (2006.01)

(52) U.S. Cl. ..... 439/353; 439/607.55

(58) Field of Classification Search ..... 439/353, 439/354, 357

See application file for complete search history.

(56) References Cited

U.S. PATENT DOCUMENTS 4,872,736 A * 10/1989 Myers et al. ..... 385/60
5,533,908 A * 7/1996 Henry et al. ..... 439/329
6,558,183 B1 5/2003 Ji
7,033,218 B2 * 4/2006 Huang et al. ..... 439/607.04
7,258,565 B2 * 8/2007 Huang et al. ..... 439/353
7,422,465 B2 * 9/2008 Watanabe et al. ..... 439/353
7,594,827 B2 * 9/2009 Takamoto et al. ..... 439/660

* cited by examiner

*Primary Examiner*—Neil Abrams

(57) ABSTRACT

An electrical connector includes an insulating housing having a front frame and a rear frame engaged with the front frame. The front frame defines at least two receiving grooves at a top portion and a bottom portion thereof respectively. The rear frame defines at least one fixing groove passing through a front portion thereof. At least one latch member has a hollowed bearing portion extending from both distal ends thereof to form two resilient arms. The bearing portion and the resilient arms are received in the fixing groove of the rear frame. A tip end of each resilient arm extending into the corresponding receiving groove protrudes to form a limiting portion which is exposed out of the receiving groove of the front frame, and a plurality of terminals is disposed in the insulating housing respectively.

9 Claims, 4 Drawing Sheets

ELECTRICAL CONNECTOR WITH LATCHING MEMBER

BACKGROUND OF THE INVENTION

1. Field of the Invention

The present invention generally relates to an electrical connector, and more particularly to an electrical connector with latch means capable of being conveniently assembled in the electrical connector.

2. The Related Art

Nowadays, an electrical connector is widely used in many electric apparatus for connecting with a mating connector so as to transmit signals or power therebetween. The electrical connector generally includes an insulating housing, a plurality of terminals received in the insulating housing respectively and latch means assembled in the insulating housing in order to increase the connection stability between the electrical connector and the mating connector.

For example, an electrical connector is disclosed in U.S. Pat. No. 6,558,183 issued on May 6, 2003. It has a casing, a mating portion and a latch means. The latch means includes a pair of lock members and a pair of release buttons. Each lock member includes a resilient lock arm, a pawl formed on one end of the lock arm and a fixing foot formed on the other end of the lock arm. The lock members are respectively disposed at lateral sides of the electrical connector and the release buttons are disposed at outer sides of the lock members correspondingly. To disengage the electrical connector from a mating connector, the release buttons are inwardly depressed such that the lock arms are deflected appropriately, so that the pawls are depressed and the electrical connector is released from the mating connector.

However, the operation of assembling the latch means in the electrical connector and disengaging the electrical connector from the mating connector is complicated and inconvenient. Then, an improved electrical connector with latch means capable of being conveniently assembled in the electrical connector is intensely desired.

SUMMARY OF THE INVENTION

Accordingly, an object of the present invention is to provide an electrical connector with latch means capable of being conveniently assembled in the electrical connector. The electrical connector includes an insulating housing having a front frame and a rear frame engaged with the front frame. The front frame defines at least two receiving grooves at a top portion and a bottom portion thereof respectively. The rear frame defines at least one fixing groove passing through a front portion thereof. At least one latch member has a hollowed bearing portion extending from both distal ends thereof to form two resilient arms. The bearing portion and the resilient arms are received in the fixing groove of the rear frame. A tip end of each resilient arm extending into the corresponding receiving groove protrudes to form a limiting portion exposed out of the receiving groove of the front frame, and a plurality of terminals is disposed in the insulating housing respectively.

As described above, as the insulating housing of the electrical connector includes the front frame and the rear frame, the latch member is firstly assembled in the fixing groove defined in the rear frame and then the rear frame as well as the latch member are assembled together with the front frame, which facilitates the latch member being assembled in the insulating housing, so that the assembly efficiency of the electrical connector is improved.

BRIEF DESCRIPTION OF THE DRAWINGS

The present invention will be apparent to those skilled in the art by reading the following description of a preferred embodiment thereof, with reference to the attached drawings, in which.

DETAILED DESCRIPTION OF THE PREFERRED EMBODIMENT

Figure 1:
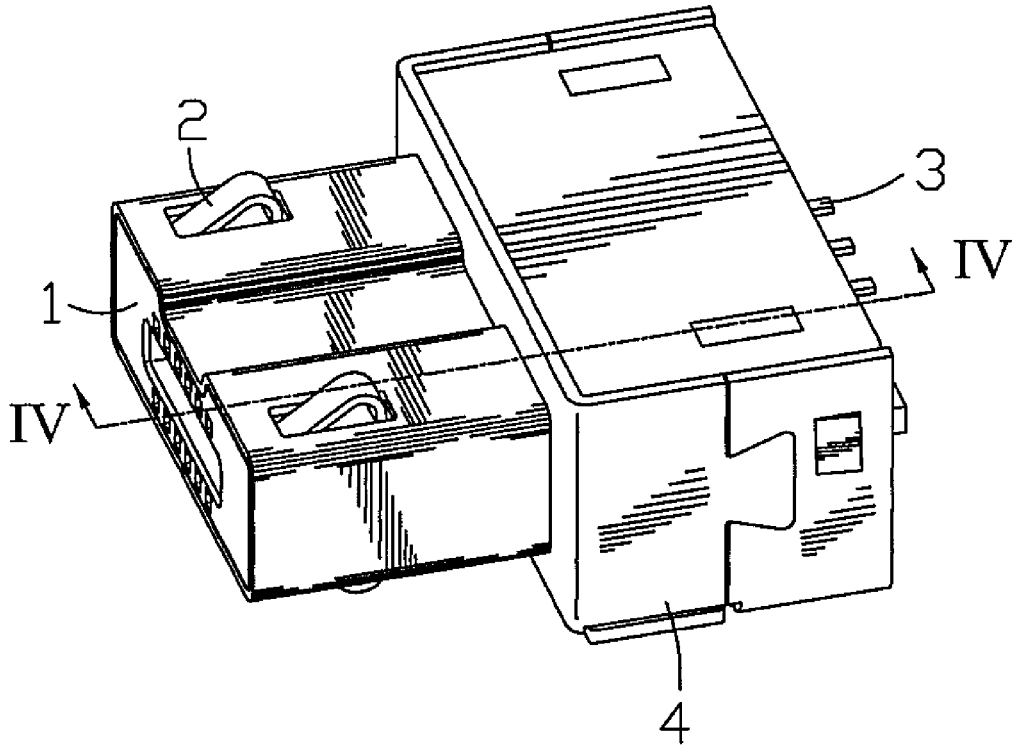
FIG. 1 is a perspective view of an electrical connector according to the present invention.
Figure 2:
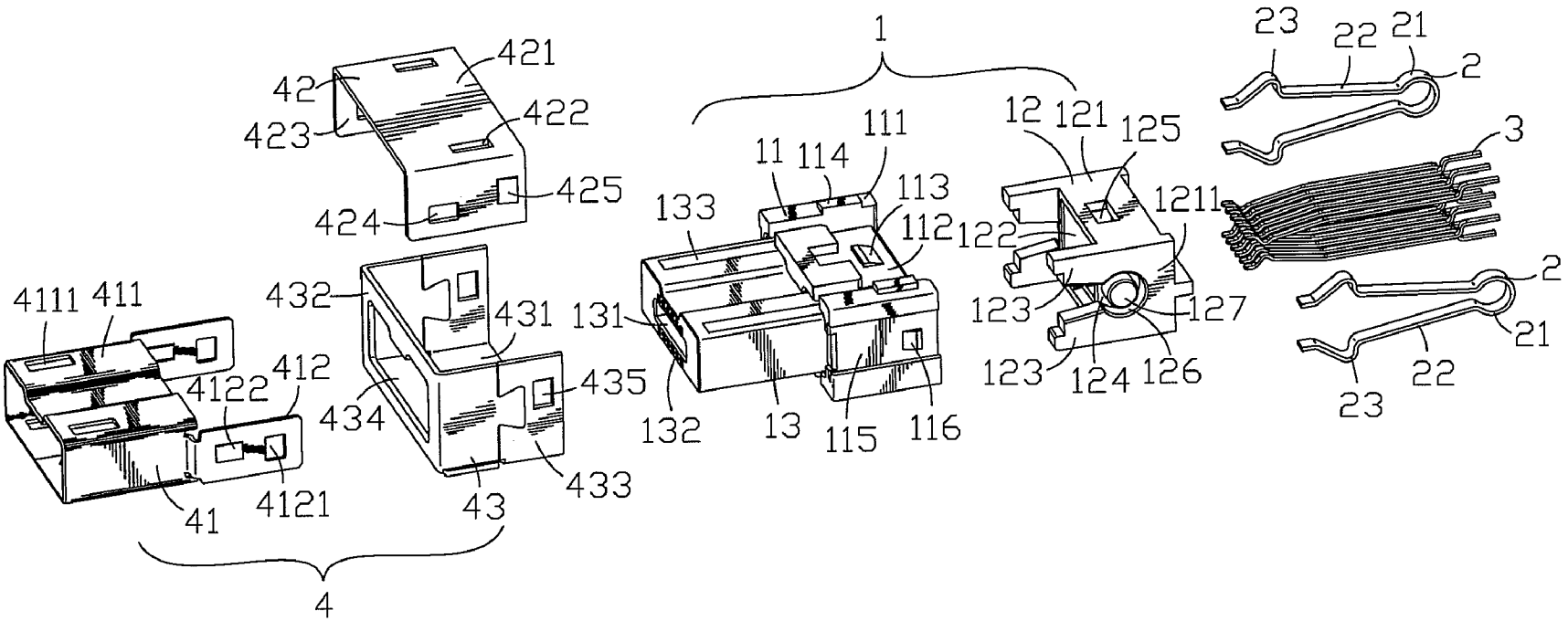
FIG. 2 is an exploded view of the electrical connector of FIG. 1 while shown in another perspective.

Referring to FIG. 1 and FIG. 2, an electrical connector according to the present invention is illustrated that includes an insulating housing 1, a plurality of terminals 3 received in the insulating housing 1, a pair of latch members 2 disposed respectively at both lateral sides of the insulating housing 1 and a shell 4 enclosing the insulating housing 1 therein, all of which will be described in detail hereinafter.

With reference to FIG. 2, the insulating housing 1 includes a front frame 11 and a rear frame 12 disposed at the rear portion of the front frame 11. The front frame 11 has a rear base 14, of which a front portion protrudes frontward to form a front base 13 at a middle portion thereof. The front base 13 defines an inserting mouth 131 at a front portion thereof. A plurality of terminal slots 132 is defined in the front base 13 and respectively communicates with the inserting mouth 131. The terminal slots 132 are divided into two groups, and in other words, one group is disposed at the top of the inserting mouth 131, and the other group at the bottom thereof. The two groups of the terminal slots 132 pass through the whole front base 11. The front base 13 further defines two pairs of receiving grooves 133. Each pair of the receiving grooves 133 is disposed opposite each other at a top portion and a bottom portion of the front base 13. The two pairs of the receiving grooves 133 respectively extend to pass through a top portion and a bottom portion of the rear base 14 and are respectively adjacent to opposite two sidewalls 111 of the rear base 14. A rear portion of the rear base 14 extends rearward to define an inserting portion 112 at a middle portion thereof. The inserting portion 112 keeps a distance from the two sidewalls 111 disposed at lateral sides of the inserting portion 112. A top portion and a bottom portion of the inserting portion 112 respectively protrude partially to form a protrusion 113 thereon. The two sidewalls 111 protrude upward at top portions thereof to respectively form a locating portion 114 thereon. Outer sides of the two sidewalls 111 respectively define an accommodating recess 115 passing therethrough. A first fixing bump 116 is defined in the accommodating recess 115.

The rear frame 12 defines a top surface 121 and two side surfaces 128. A front surface (not labeled) of the rear frame 12 defines a holding space 122 passing therethrough and extending toward the inside of the rear frame 12. The top surface 121 and a bottom surface (not labeled) of the rear frame 12 respectively define a locating aperture 125 communicating with the holding space 122. A front portion of each side surface 128 extends frontward to form a retaining portion 123. Each side surface 128 defines a fixing groove 124. The fixing groove 124 is formed of an open circular-shaped jamming groove 126 defined in the side surface 128 and an extending groove 129 extending frontward from the jamming groove 126 and passing through the middle of the retaining portion 123 to divide the retaining portion 123 into two branches. The extending groove 129 gradually becomes wider from rear to front. A column-shaped protruding pillar 127 protrudes outward at the middle of the jamming groove 126. A rear surface of the rear frame 12 defines a plurality of terminal cavities (not shown).

Each of the latch members 2 has an open circular-shaped bearing portion 21. Free ends of the bearing portion 21 respectively extend frontward to form two facing resilient arms 22. The distance between the two resilient arms 22 gradually becomes wider from rear to front. A tip end of each of the resilient arms 22 protrudes to form a limiting portion 23.

The shell 4 enclosing the insulating housing 1 therein includes a front shell 41, an upper shell 42 and a lower shell 43. The front shell 41 has a hollow receiving portion 411. The receiving portion 411 defines two pairs of fixing recesses 413 at opposite sides of a top portion and a bottom portion thereof. Rear portions of lateral sides of the receiving portion 411 extend rearward to respectively form a locating plate 412. Each of the locating plates 412 defines a first fixing hole 414 and a second fixing bump 415.

The upper shell 42 has a top board 421 and two sideboards 423 extending downward from opposite sides of the top board 421. The top board 421 defines two locating cavities 422 at the opposite sides thereof. Each of the sideboards 423 defines a second fixing hole 424 and a third fixing bump 425.

The lower shell 43 has a bottom wall 431 of which front portion and opposite side portions respectively extend upward to form a front wall 432 and two sidewalls 433 connecting with the front wall 432. The front wall 432 defines a rectangular through-hole 434. Each of the sidewalls 433 defines a third fixing hole 435 thereon.

Figure 3:
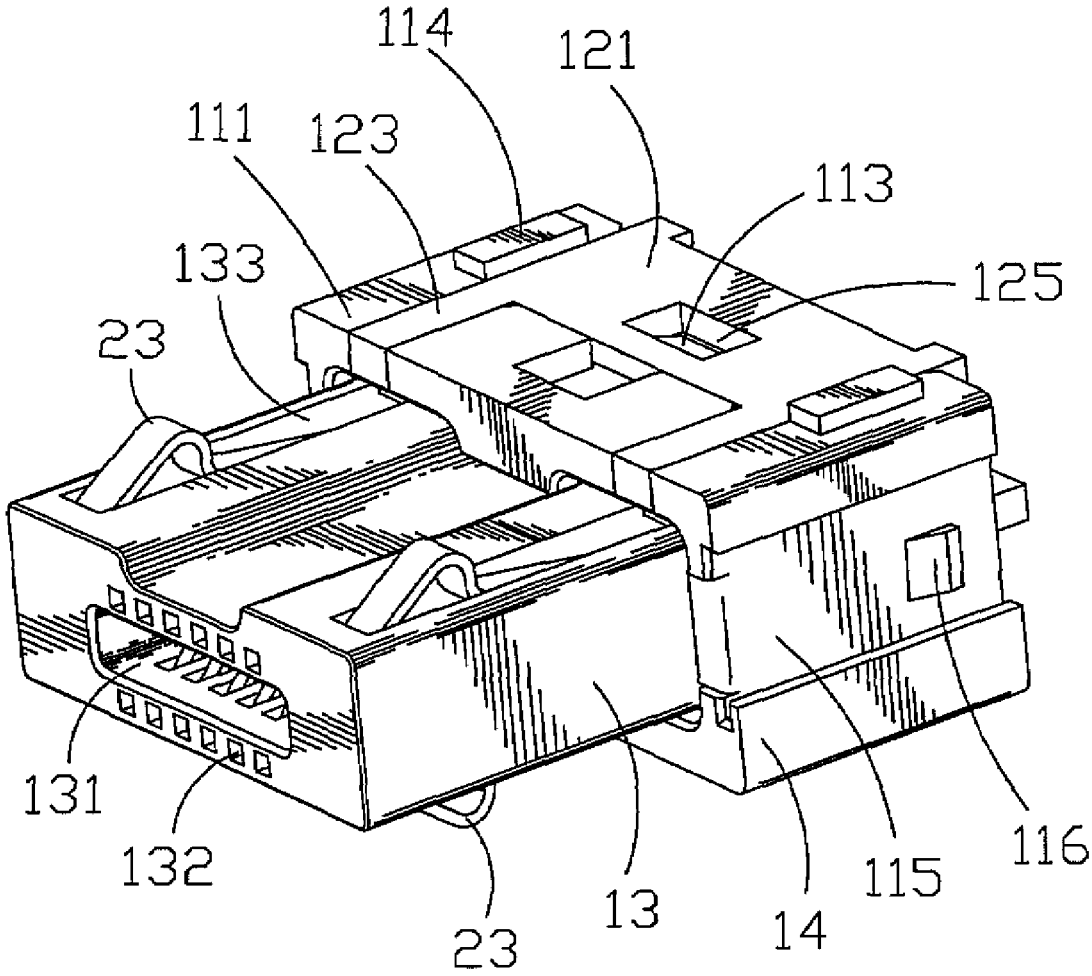
FIG. 3 is an assembly view of the electrical connector of FIG. 1 with a shell thereof removed.
Figure 4:
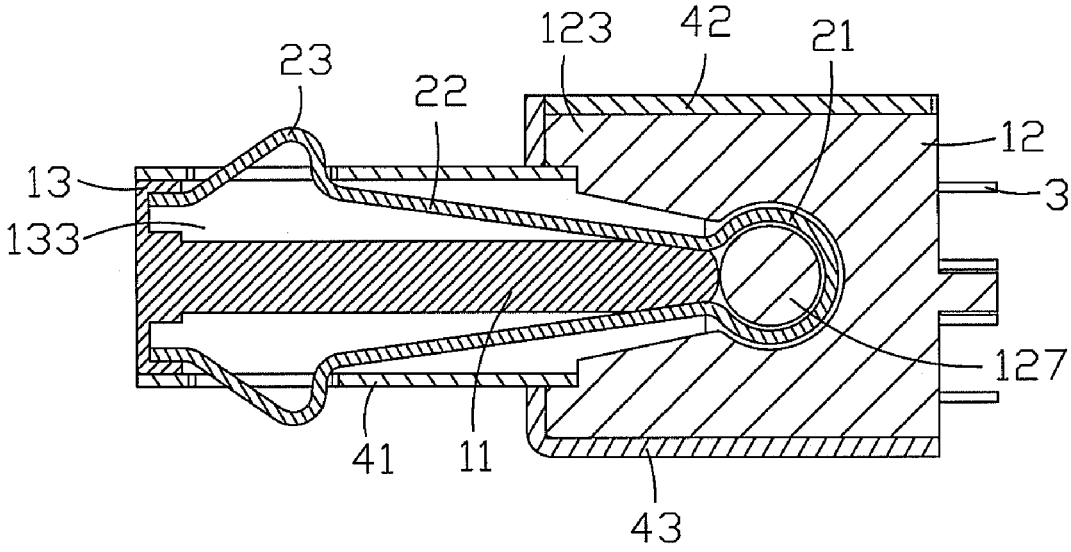
FIG. 4 is a cross-sectional view taken along line IV-IV of FIG. 1.

Please refer to FIG. 2, FIG. 3 and FIG. 4, in assembly, the terminals 3 are respectively received in the terminal slots 132 of the front frame 11. Then the latch members 2 are disposed in the fixing grooves 124 of the rear frame 12. The bearing portion 21 is inserted into the jamming groove 126 and then surrounds the protruding pillar 127. The resilient arms 22 are received in the extending groove 129. Subsequently, the rear frame 12 is assembled together with the front frame 11. The retaining portions 123 are respectively disposed in the receiving grooves 133 defined on the top portion and the bottom portion of the rear base 14. The resilient arms 22 disposed in the extending grooves 129 defined in the retaining portions 123 are received in the receiving grooves 133 of the front base 13 and the rear base 14. The limiting portions 23 protrude out of the receiving grooves 133 defined on the front base 13 for engaging with a mating connector. The holding space 122 receives the inserting portion 112 with the protrusions 113 located in the locating apertures 125 for fastening the rear frame 12 together with the front frame 11. Rear ends of the terminals 3 extend out of the terminal cavities of the rear frame 12. Then the front base 13 is disposed in the receiving portion 411 of the front shell 41. The limiting portions 23 of the latch members 2 respectively protrude out of the fixing recesses 413 of the front shell 41. The locating plates 412 are inserted in the accommodating recesses 115 and the first fixing holes 414 receive the first fixing bumps 116 therein for fixing the front shell 41 together with the front frame 11 of the insulating housing 1. Then the upper shell 42 covers on the rear base 14 of the front frame 11 and the top surface 121 of the rear frame 12. The locating cavities 422 of the upper shell 42 receive the locating portions 114 of the rear base 14 therein. The second fixing holes 424 of the upper shell 42 fixedly receive the second fixing bumps 415 of the front shell 41. Finally, the combination of the insulating housing 1, the terminals 3, the latch members 2, the front shell 41 and the upper shell 42 is assembled together with the lower shell 43. The receiving portion 411 receiving the front base 13 stretches outward from the through-hole 434 of the lower shell 43. The rear base 14 of the front frame 11 and the rear frame 12 are placed on the bottom wall 431 of the lower shell 43. The third fixing bumps 425 of the upper shell 42 are fixed in the third fixing holes 435.

In use, the electrical connector couples with the mating connector, and at the same time, the limiting portions 23 of the latch members 2 are engaged with the mating connector for increasing the connection stability between the electrical connector and the mating connector.

As described above, as the insulating housing 1 of the electrical connector includes the front frame 11 and the rear frame 12, the latch members 2 are firstly assembled in the fixing grooves 124 defined in the rear frame 12 and then the rear frame 12 as well as the latch members 2 is assembled together with the front frame 11, which facilitates the latch members 2 being assembled in the insulating housing 1, so that the assembly efficiency of the electrical connector is improved.

The foregoing description of the present invention has been presented for purposes of illustration and description. It is not intended to be exhaustive or to limit the invention to the precise form disclosed, and obviously many modifications and variations are possible in light of the above teaching. Such modifications and variations that may be apparent to those skilled in the art are intended to be included within the scope of this invention as defined by the accompanying claims.

What is claimed is:

1. An electrical connector, comprising:

an insulating housing having a front frame and a rear frame engaged with the front frame, the front frame defining at least two receiving grooves at a top portion and a bottom portion thereof respectively, the rear frame defining at least one fixing groove passing through a front portion thereof;

at least one latch member having a hollowed bearing portion, two resilient arms extended from both distal ends of the bearing portion, the bearing portion and the resilient arms being received in the fixing groove of the rear frame, a tip end of each resilient arm extending into the corresponding receiving groove and protruding further to form a limiting portion exposed out of the receiving groove of the front frame; and a plurality of terminals disposed in the insulating housing.

2. The electrical connector as claimed in claim 1, further comprising a shell fixedly enclosing the insulating housing and defining at least two fixing recesses which are opposite each other and located in a top portion and a bottom portion thereof respectively, the limiting portion being exposed out of the fixing recess of the shell.

3. The electrical connector as claimed in claim 1, wherein the bearing portion of the latch member is substantially of an open circular-shape, the fixing groove has a substantially open circular-shaped jamming groove and an extending groove extending from the jamming groove and passing through the front portion of the rear frame, the bearing portion is disposed in the jamming groove and the two resilient arms are disposed in the extending groove.

4. The electrical connector as claimed in claim 3, wherein the distance between the two resilient arms of the latch member gradually becomes wider along a direction away from the bearing portion towards the limiting portion, and the extending groove gradually becomes wider in the same manner as the resilient arms to receive the two resilient arms therein.

5. The electrical connector as claimed in claim 3, wherein the jamming groove defines a protruding pillar therein, the bearing portion of the latch member surrounds the protruding pillar.

6. The electrical connector as claimed in claim 3, wherein the rear frame extends frontward to form a retaining portion, the extending groove passes through the retaining portion, and then the retaining portion is divided into two branches located in the receiving grooves of the front frame.

7. The electrical connector as claimed in claim 1, wherein the front frame extends rearward from a rear portion thereof to define an inserting portion, and the rear frame defines a holding space to receive the inserting portion therein.

8. The electrical connector as claimed in claim 7, wherein the inserting portion protrudes to form at least one protrusion thereon, and the rear frame defines at least one locating aperture communicating with the holding space and receiving the protrusion therein.

9. The electrical connector as claimed in claim 7, wherein the inserting portion is disposed between and spaced away from two sidewalls, and the rear frame is held between the two sidewalls.

* * * * *